US005093932A

United States Patent [19]

Doyle

[11] Patent Number: 5,093,932

[45] Date of Patent: Mar. 10, 1992

[54] EXAMINATION GARMENT

[76] Inventor: Maureen Doyle, 296 Mill Rd., Unit C7, Etobicoke, Ontario M9L 4X8, Canada

[21] Appl. No.: 583,635

[22] Filed: Sep. 17, 1990

[51] Int. Cl.[5] ..... A41D 1/06; A41D 13/00

[52] U.S. Cl. ..... 2/114; 2/78 A; 2/78 B; 2/79; 2/227; 2/408; 2/DIG. 7

[58] Field of Search ..... 2/75, 78 A, 78 B, 79, 2/80, 114, 227, DIG. 7, 402, 404, 406, 408

[56] References Cited

U.S. PATENT DOCUMENTS

| | | | |
|---|---|---|---|
| 454,813 | 6/1891 | O'Brien | 2/78 B |
| 570,971 | 11/1896 | Velasko | 2/78 A |
| 681,061 | 8/1901 | Lautenbacher | 2/78 B |
| 1,100,657 | 6/1914 | Hatch | 2/78 A |
| 1,103,255 | 7/1914 | Bilbrough | 2/78 B |
| 1,251,439 | 12/1917 | Strausse | 2/78 B |
| 1,457,752 | 6/1923 | Rood | 2/78 B |
| 1,489,208 | 4/1924 | Hansel | 2/78 B |
| 1,615,922 | 2/1927 | Williams | 2/78 B |
| 1,633,972 | 6/1927 | Berry | 2/78 B |
| 1,740,554 | 12/1929 | Trageser | 2/78 B |
| 1,854,262 | 4/1932 | Johannesen | 2/79 |
| 1,998,051 | 4/1935 | Gerber | 2/114 |
| 2,264,958 | 12/1941 | Smith | 2/227 |
| 2,520,026 | 8/1950 | Beitchman | 2/227 |
| 3,144,659 | 8/1964 | Matthews | 2/83 |
| 4,304,006 | 12/1981 | Swart | 2/79 X |
| 4,370.757 | 2/1983 | Richmond | 2/400 |
| 4,570,268 | 2/1986 | Freeman | 2/114 |
| 4,653,120 | 3/1987 | Leaf | 2/114 |
| 4,759,083 | 7/1988 | Belcher | 2/114 |
| 4,771,480 | 9/1988 | Stimson et al. | 2/88 |
| 4,853,977 | 8/1989 | Foreman | 2/79 |
| 4,920,578 | 5/1990 | Janzen et al. | 2/114 |

FOREIGN PATENT DOCUMENTS

| | | | |
|---|---|---|---|
| 1133684 | 4/1957 | France | 2/227 |
| 415053 | 8/1934 | United Kingdom | 2/78.1 |

*Primary Examiner*—Werner H. Schroeder
*Assistant Examiner*—Jeanette E. Chapman
*Attorney, Agent, or Firm*—Rogers, Bereskin & Parr

[57] ABSTRACT

A garment for use in patient examinations where particular examinable areas remain covered until they are individually accessed or until the patient is placed in an examining position. The garment comprises an upper portion for receiving and covering the patient's upper body, and a trouser portion for receiving and covering the patient's lower body. There is also provided upper access means located on the upper portion for exposing an upper examinable area, and lower access means located on the trouser portion for exposing a lower examinable area.

13 Claims, 6 Drawing Sheets

EXAMINATION GARMENT

FIELD OF THE INVENTION

This invention relates to the field of medical quipment and in particular, to an examination garment for use by patients for examination purposes.

BACKGROUND OF THE INVENTION

Generally when a patient attends at their doctor's office or a medical clinic, they must undress at least partially in the examination room prior to being examined. This can be both a waste of time for the doctor waiting to examine the patient, as well as embarrassing for the patient disrobing in the presence of the doctor. The patient may also feel uncomfortable when required to maintain their state of undress throughout the examination. From the doctor's point of view, examinations may be accelerated if the patient is provided an examination gown to change into prior to meeting with the examining doctor. Unfortunately, from the patient's point of view, the conventional examination gown serves only to aggravate their discomfort.

Conventional gowns tend to be awkward for the patient to put on, and embarrassing for the patient to be seen in. The conventional hospital gown wraps around the patient's front and ties at the patient's back. Typically the patient needs assistance in tying the rear ties. The rear of the gown remains substantially open and reveals at least a portion of the patient's posterior. The gown is consistently unflattering and many patients, particularly male patients, feel foolish wearing a gown or dress-like garment. Consequently, the patient feels foolish and inferior prior to their examination.

The conventional gown does not alleviate any of the embarrassment a patient may feel during the examination. The conventional hospital gown has a solid front so that often the patient must still remove most of the gown in order that the doctor may examine particular areas. Breast examinations and gynecological examinations are examples of situations where the patient is required to remove or lift up a substantial portion of the examination gown. Consequently, the patient is forced to maintain a state of substantial undress during the examination.

Medical garments, such as the one diclosed by F. E. Belcher in U.S. Pat. 4,759,083, provide a partial solution to the problem posed by the conventional gown. This garment provides panels and parts with releasable closures such that certain panels and parts are selectively separated for examination access while the garment is still being worn by the patient. Consequently, the patient is not inconvenienced by having to remove a substantial portion of the gown in order to be examined in one specific area. Nevertheless, for the purposes of certain examinations such as gynecological examinations, a substantial portion of the garment must still be lifted or pulled out of the way in order for the doctor to properly examine the patient Thus, the patient is placed in an inferior and embarrassing position by being forced to maintain a state of substantial undress during the examination. In addition, as stated earlier, patients, and male patients especially, feel uncomfortable when wearing a gown or dress-like garment.

The practice of requiring a patient to wear such a gown for examination can be quite detrimental to the patient, and can affect the quality of the examination The patient may develop a feeling of inferiority when placed in a poorly fitting gown that exposes a substantial portion of the patient's legs and posterior. Such a feeling of inferiority can build a sense of resentment against the doctor who ultimately will be examining the patient. The patient will remain tense during examination, and the examination itself consequently may be made more difficult.

In addition, if a patient feels uncomfortable during their examination due to the outfit they are required to wear, and if ultimately the patient must lift or remove a substantial portion of the gown in order that they may be examined,. the patient may leave the examination in an embarrassed state and may be hesitant to voluntarily attend at a future examination. Given recent technological developments leading to early detection of various illnesses including, for instance, certain forms of cancer, it is desirable that patients be encouraged to attend at regular examinations. Such attendance may be facilitated if the examination is carried out in a less objectionable way.

It is therefore desirable that an examination garment be developed that more closely resembles an article of clothing that may be worn by both men and women. The garment should ensure the maintenance of the patient's dignity and sense of well being by substantially covering the patient's body and preventing undesired exposure of the patient's private areas while providing proper access to examinable areas for the examining doctor. In addition, the garment should be inexpensive, durable, and fit a wide variety of sizes.

SUMMARY OF THE INVENTION

The present invention provides a garment for use in patient examinations where particular examinable areas remain covered until they are individually accessed or until the patient is placed in an examining position. The garment comprises an upper portion for receiving and covering the patient's upper body, and a trouser portion for receiving and covering the patient's lower body. There is also provided upper access means located on, the upper portion for exposing an upper examinable area of the patients front and back, and lower access means located on the trouser portion for exposing a lower examinable area. The lower access means located on the trouser portion includes a crotch slit for exposing the groin area of the patient. The crotch slit extends from the inside thigh portion of one leg of the trouser portion, through the crotch of the trouser portion to the inside thigh portion of the other leg of the trouser portion. Excess fabric surrounds the crotch slit and contacts to cover the crotch slit until the patient is placed in an examining position.

Therefore, what is provided is a preferably one piece garment that substantially covers the patient's entire body. The garment resembles a jump suit or coveralls such that both male and female patients, including infants, may feel comfortable wearing it. The garment features means for accessing various examinable areas in a discreet fashion. Substantial portions of the patient remain covered while any one examinable area is exposed.

DETAILED DESCRIPTION OF THE PREFERRED EMBODIMENT

Figure 4:
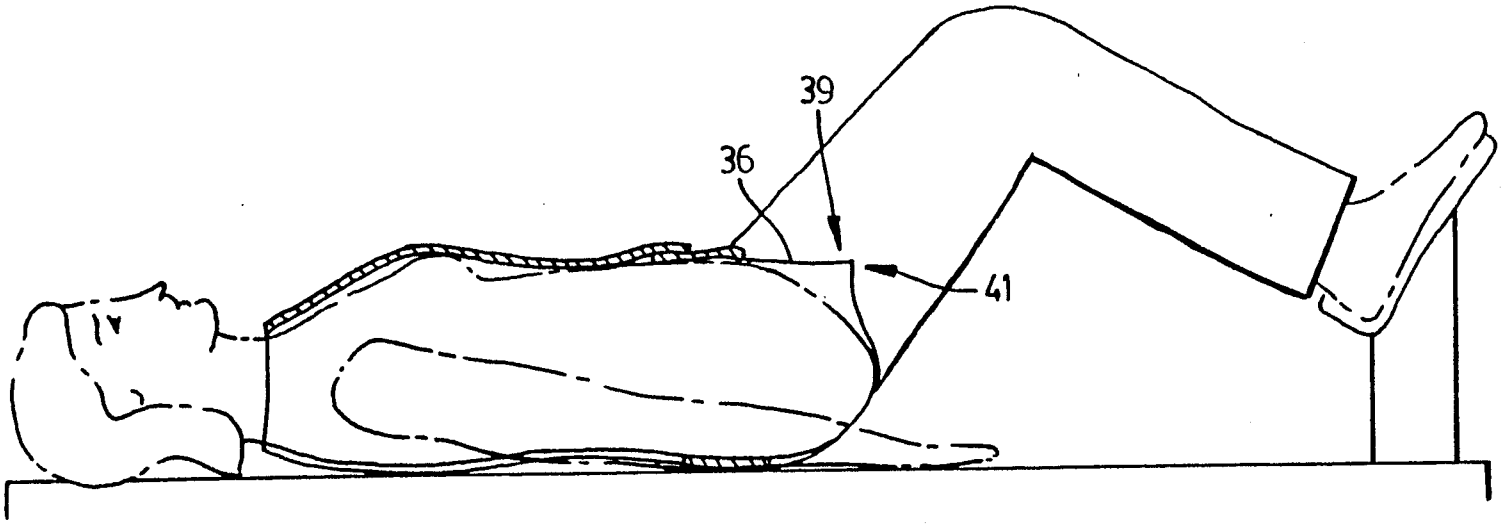
FIG. 4 is a part sectional side elevation of an examination garment according to the present invention in use on a patient in an examining position.
Figure 5:
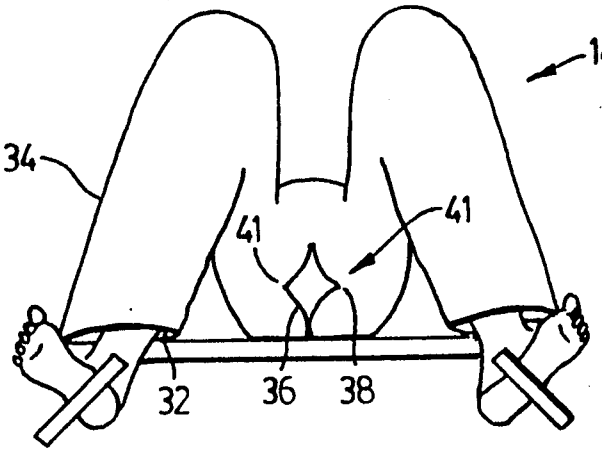
FIG. 5 is an end elevation of an examination garment according to the present invention in use on a patient in an examining position.
Figure 6:
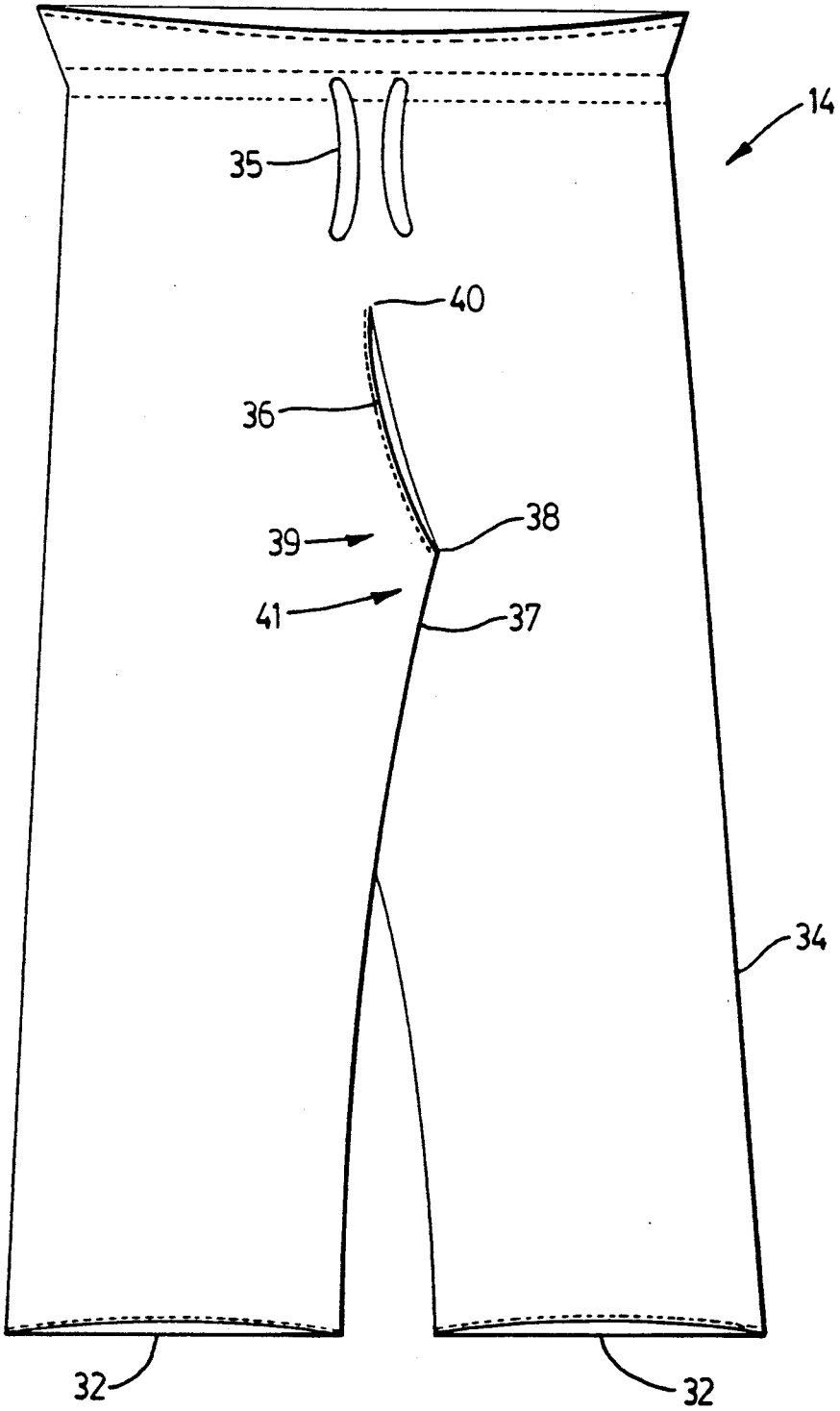
FIG. 6 is a front elevation of an alternative embodiment of an examination garment according to the present invention.
Figure 7:
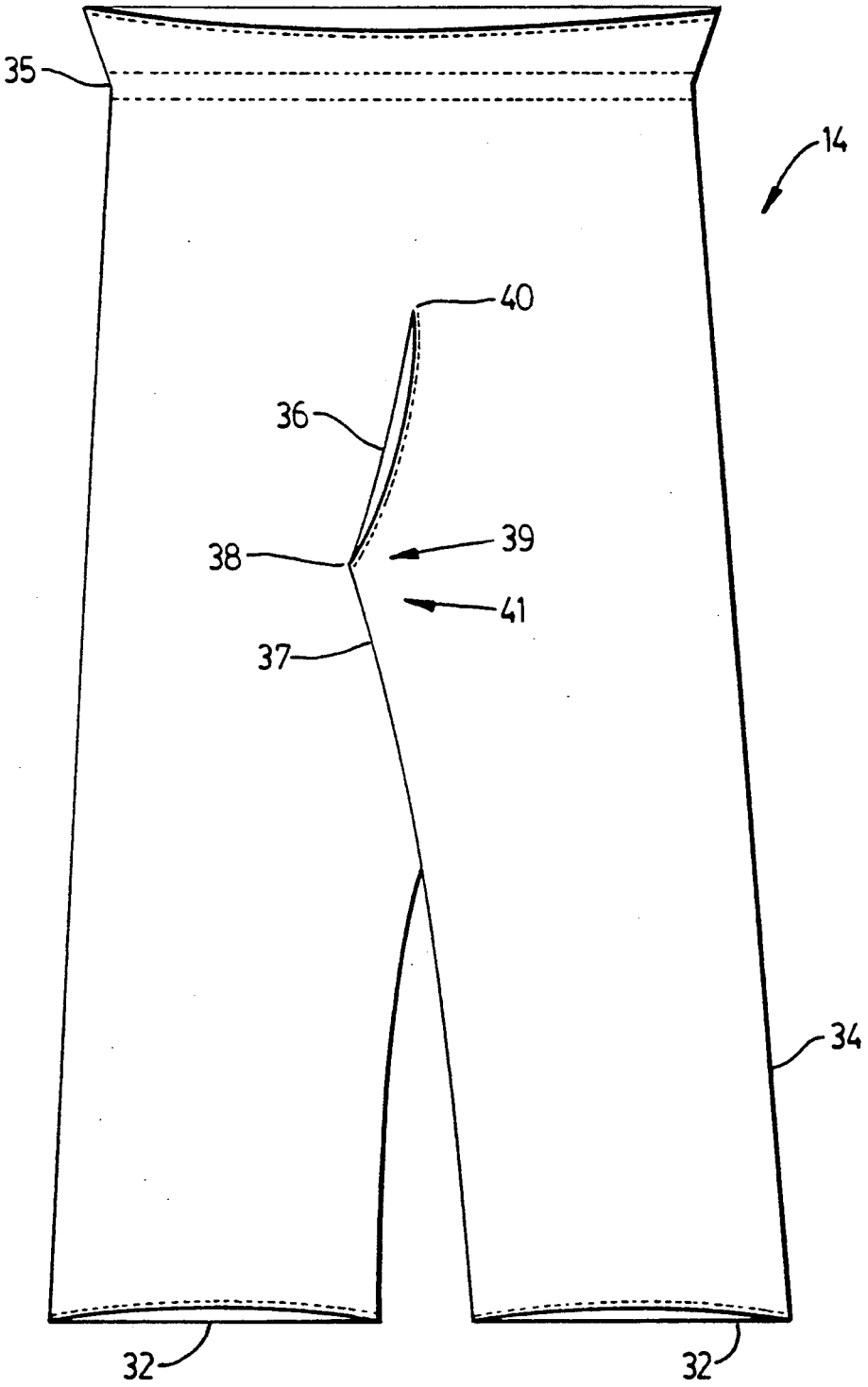
FIG. 7 is a rear elevation of an alternative embodiment of an examination garment according to the present invention.

An examination garment which is a preferred embodiment of the present invention is illustrated at 10 in FIGS. 1 through 5. The upper portion for receiving and covering the patient's upper body is generally indicated at 12 and the trouser portion for receiving and covering the patient's lower body is generally indicated at 14. Since the preferred embodiment features the examination garment 10 as a one piece outfit, it should be appreciated that the upper portion 12 and the trouser portion 14 are in fact regions of a single piece and are not separable pieces. Nevertheless, it is conceivable that the examination garment 10 may be provided in separate upper and trouser portions. An example of a separate trouser portion 14 is shown in FIGS. 6 and 7.

The examination garment 10 may be inexpensively constructed using a durable fabric made of a cotton and polyester blend as is known in the trade. Alternative fabrics including disposable fabric blends constructed substantially of paper may also be used.

Due to its nature as a loose fitting, full length garment where sleeves need not be provided and where the trouser legs may be rolled to a desired height, the garment may be constructed as a "one size fits all" outfit. In cases where the garment is used on infants or young adults, it is of course conceivable that the garment be available in a variety of sizes.

The upper portion 12 has a neck opening 16 and arm openings 18. The preferred embodiment 10 is sleeveless, however the upper portion 12 could be constructed with sleeves.

The upper portion 12 has means for accessing various examinable areas located on the patient's front and back. Typical examinable areas may include the patient's breasts, lymph nodes, or general back area. The upper access means may then be selectively opened to reveal the desired examinable area while the remainder of the patient's body remains unexposed.

Figure 1:
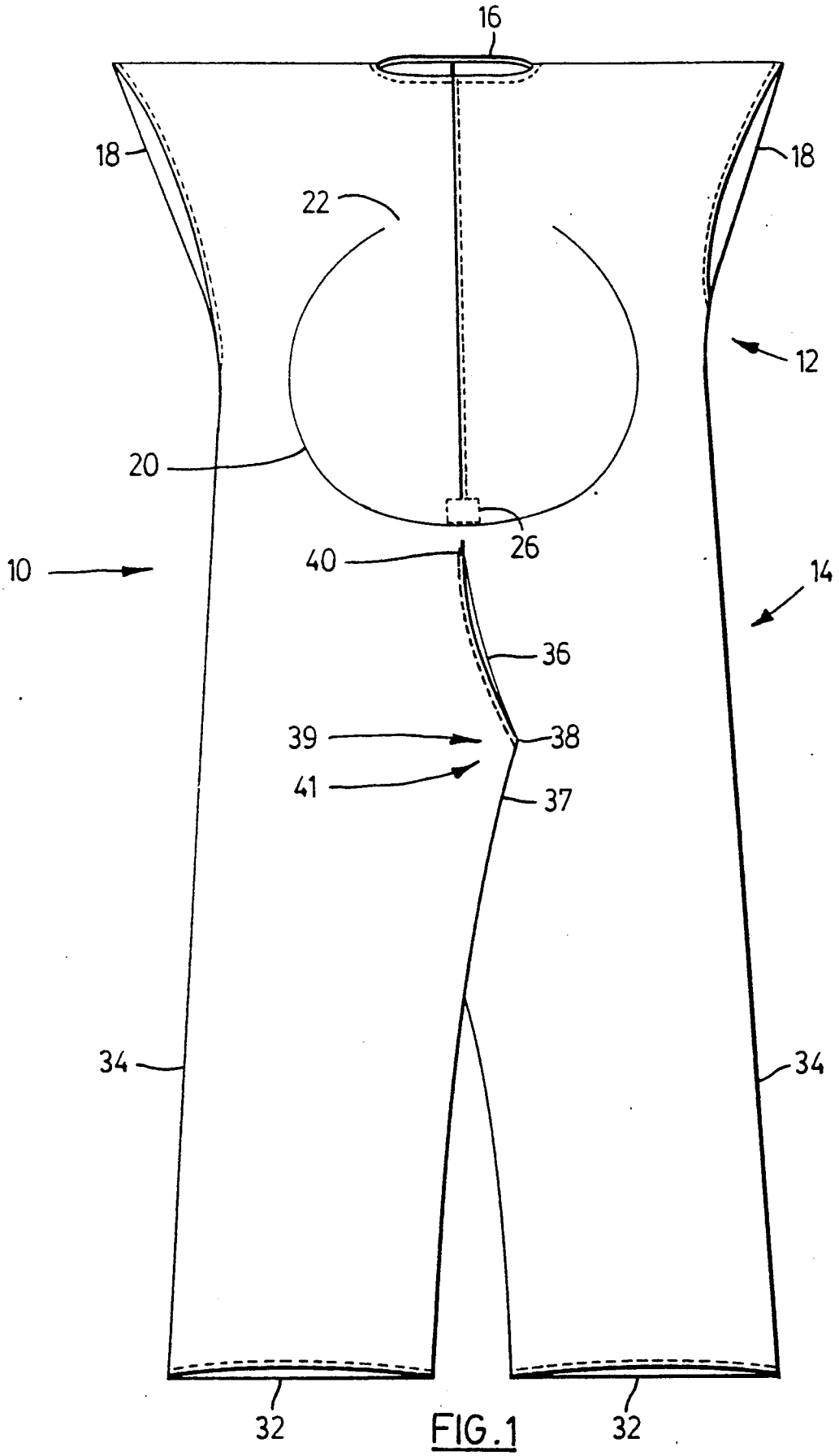
FIG. 1 is a front elevation of an examination garment according to the present invention.
Figure 2:
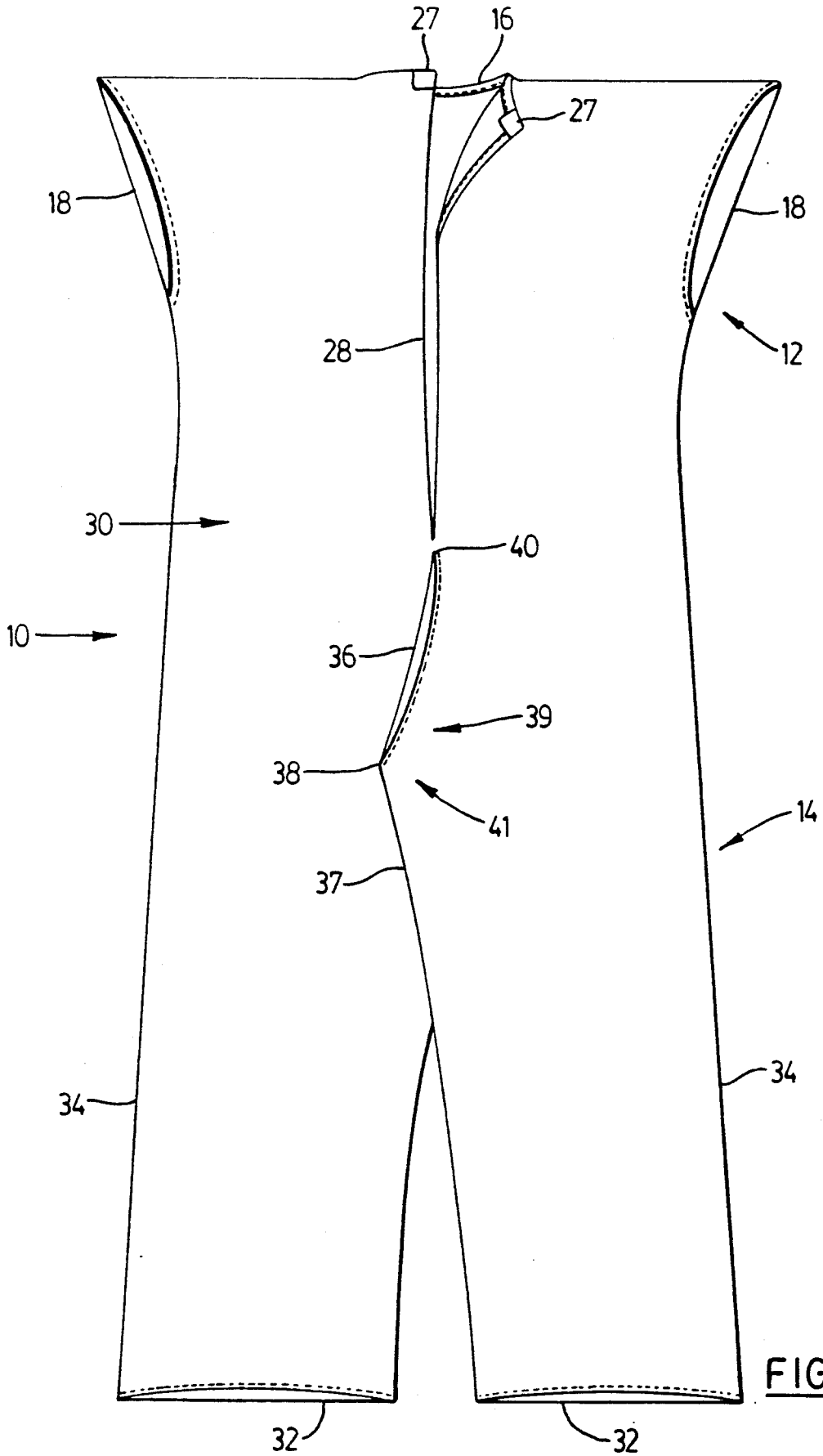
FIG. 2 is a rear elevation of an examination garment according to the present invention.
Figure 3:
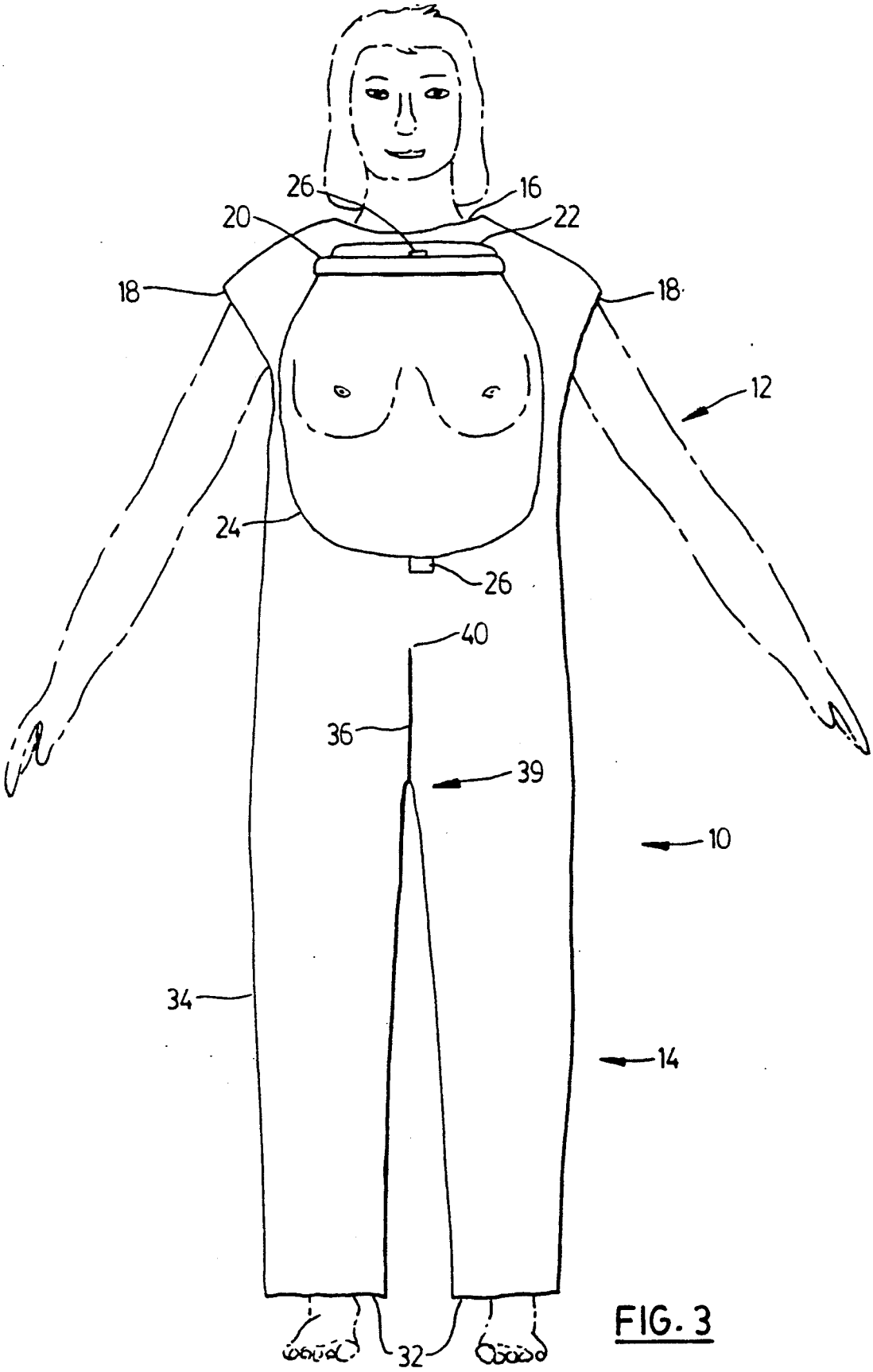
FIG. 3 is a front elevation of an examination garment according to the present invention in use on a patient.

In the preferred embodiment, the access means for exposing the patient s front consists of a flap 20. The flap 20 hinges at the uppermost edge 22 of the flap opening 24 such that the flap 20 may be lifted or rolled upwards to expose the examinable area as shown in FIG. 3. Alternatively, the flap 20 may hinge at the lowermost portion of the flap opening 24, in which case the flap 20 would drop downwards to expose the examinable area. The former flap embodiment is preferred to the latter because of the tendency for the former flap 20 to hang in a closed position due to natural gravitational forces. Consequently, the examinable areas remain covered until they are selected to be accessed.

A releaseable fastener 26 may be provided to retain the flap 20 in a closed position. In the preferred embodiment, the releasable fastener 26 consists of a hook-and-loop fastening mechanism such as the type sold under the trademark "VELCRO". A simple button fastener would also be quite adequate. Clearly, a wide range of releasable fasteners may be suitable for the intended purpose.

The access means for exposing the patient's back consists of a back slit 28. The back slit 28 runs from the neck opening 16 along the patient's spine to the waist region 30 of the examination garment 10. The back slit 28 is maintained in a closed position by means of a releasable fastener 27 located at the neck opening 16. The releasable fastener 27 may consist of a hook-and-loop fastening mechanism, a button, or any of a wide range of releasable fasteners as discussed above. When the releasable fastener 27 is disengaged, the back slit 28 may be opened to reveal the central portion of the patient's back from their neck to their waist.

The back slit 28 further provides an opening to allow the patient to don the examination garment 10. The one piece construction of the preferred embodiment necessitates the provision of a suitable entry for the patient.

A small portion of the patient's back may be visible when the back slit 28 is held in a closed position by the releasable fastener 26. Generally patients do not tend to feel uncomfortable or embarrassed when their back is partially exposed. Nevertheless, alternative embodiments where the means for exposing the patient's back consists of a flap similar to flap 20 which covers the patient's front. In case a flap is provided as access means for exposing the patient's back, an alternative method of entering the examination garment 10 would be necessary. For example, the garment may be of two pieces consisting of an upper portion and a trouser portion. Alternatively, a releasably fastened slit located along one side of the upper portion of the examination garment, or releasably fastened shoulder slits located along the length of each shoulder of the upper portion may be used.

The trouser portion 14 has leg openings 32 located at the lowermost portion of each trouser leg 34. A separate trouser portion 14 as shown in FIGS. 6 and 7 is an alternative to the one-piece examination garment 10. The seperate trouser portion 14 includes fastening means 35 for fastening the trouser portion 14 about the patient's waist. The fastening means are known in the trade and may include a draw-string belt or an elasticized waist band.

The trouser portion 14 has means for accessing various examinable areas located on the patient's lower body. Typical examinable areas may include the patient's groin area, or buttocks. The lower access means may then be selectively opened to reveal the desired examinable area while the remainder of the patient's body remains unexposed.

In the preferred embodiment, the access means for exposing the patient's groin area consists of a crotch slit 36 that runs in place of what would be part of the seam 37 of the trouser portion 14. The crotch slit 36 passes from a point 38 on the inside thigh portion 39 of one leg 34 of the trouser portion 14, through the crotch 40 to a point 38 on the inside thigh portion 39 of the other leg 34. A greater area of the patient's groin will be exposed during examination the further down the thigh the crotch slit 36 begins Accordingly, the length of the crotch slit 36 may be selected to suit the desired amount of exposure.

The crotch slit 36 should remain closed so that the groin area remains unexposed until the patient is placed in what is commonly known as the examining position. There are a number of known forms of the examining position, one of which is shown in FIGS. 4 and 5 and which may be referred to as the reclined examining position. Basically, the reclined examining position requires the patient to lay on their back with their back either flat or in a slightly raised position. The patient's legs are bent at the knee and typically the feet are placed on supports referred to as stirrups in order to assist the patient in maintaining the examining position. The patient's legs are spread and sometimes raised slightly to expose the groin area. The reclined examining position is typically used by gynecologists who have specialized apparatus for placing the patient in such a position. A general practioner may similarly place their patient in a reclined examining position on a regular examination table.

In order that the patient's groin area remains unexposed until the patient is placed in an examining position, excess fabric 41 may be provided in the region of the trouser portion 14 immediately surrounding the crotch slit 36. When provided with the excess fabric 41, the trouser portion 14 would somewhat resemble a standard jodhpur design except that the excess fabric 41 is located at the inside thigh portion 39 rather than the outside thigh portion of the garment. When the garment 10 is laid flat, the excess fabric 41 located at the inside thigh portion 39 of one leg 34 will at least partially overlap the excess fabric 41 located at the inside thigh portion 39 of the other leg 34 as may be seen in FIGS. 1, 2, 6 and 7. When the garment is being worn by the patient the excess fabric 41 tends to contact and overlap to substantially cover the crotch slit 36 and consequently the patient's groin area. By placing the patient in an examining position the excess fabric 41 surrounding the crotch slit 36 is drawn apart to expose the patient's groin area, as may be seen in FIG. 4.

To provide a sufficient amount of excess fabric 41 to allow a suitable overlap in order to cover the patient's groin area, it may be necessary to construct the garment 10 from four separate fabric blanks.

Alternatively, releasable fasteners as described earlier may be provided to ensure that the crotch slit remains closed until it is desired to reveal the examinable area.

Other embodiments of lower access means are conceivable where the means for exposing examinable areas located on the patient's lower body may consist of a flap or flaps similar to flap 20 which covers the patient's front.

It is to be understood that what has been described are preferred embodiments of the invention. The invention nonetheless is susceptable to certain changes and alternative embodiments fully comprehended by the spirit of the invention as described above and the scope of the claims set out below.

I claim:

1. A garment for use in patient examinations, where particular examinable areas remain covered until they are individually accsesed or until the patient is placed in an examining position, said garment comprising:

(a) an upper portion for receiving and covering the patient's upper body;

(b) a trouser portion for receiving and covering the patient's lower body;

(c) at least one upper access means located on said upper portion for exposing an upper examinable area on each of the patient's front and back;

(d) at least one lower access means on said trouser portion for exposing a lower examinable area, said lower access means including a crotch slit for exposing the groina rea and buttocks of said patient for examination, said crotch slit extending from an inside thigh portion of one leg of said trouser portion, through the crotch of said trouser portion to an inside thigh portion of the other leg of said trouser portion, said lower access means having excess fabric surrounding said crocth slit, said excess fabric contacting to cover said crocth slit until the patient is placed in an examination position.

2. A garment as claimed in claim 1, further comprising releasable fastenign means for releasably fastening at least one of said access means in a closed position.

3. A garment as claimed in claim 1, wherein at least one of said upper access means and said lower access means includes a flap.

4. A garment as claimed in claim 3, wherein said flap includes releasable fastening means for releasably fastening said flap in a closed position.

5. A garment as claimed in claim 2, wherein said upper access means located on said upper portion includes a back slit for exposing the back of said patient, said back slit passing along the back of said garment from the neck of said garment to the waist region of said garment, said back slit being releasably fastened at said neck by said releasable fastening means.

6. A garment as claimed in claim 1, wherein, when said garment is laid flat, said excess fabric located at said inside thigh portion of one leg of said trouser portion at least partially overlaps said excess fabric located at said inside thigh portion of the other leg of said trouser portion.

7. A garment as claimed in claim 2, wherein said upper access means located on said upper portion includes at least one flap for exposing the front of said patient and a back slit for exposing the back of said patient, said back slit passing from the neck of said garment to the waist region of said garment, said back slit being releasably fastened at said neck by said releasable fastening means.

8. A garment as claimed in claim 7, wherein said access means located on said trouser portion includes a crotch slit for exposing the groin area of said patient, said crotch slit extending from the inside thigh portion of one leg of said trouser portion, through the crotch of said trouser portion to the inside thigh portion of the other leg of said trouser portion.

9. A garment as claimed in claim 8, which includes excess fabric surrounding said crotch slit which contacts to cover said crotch slit until the patient is placed in a reclined examining position.

10. A garment as claimed in claim 7, wherein, when said garment is laid flat, said excess fabric located at said inside thigh portion of one leg of said toruser portion at least partially overlaps said excess fabric located at said inside thigh portion of the other leg of said trouser portion.

11. A garment as claimed in claim 10, wherein said flap is releasably fastened in a closed position by said releasable fastening means.

12. A garment for use in patient examinations, where particular examinable areas remain covered until they are individually accessed or until the patient is placed in an examining position, said garment comprising:

(a) a trouser portion for receiving and covering the patient's lower body; and (b) lower access means located on said trouser portion for exposing a lower examinable area, said lower access means including a crotch slit extending from an inside thigh portion of one leg of said trouser portion, through the crotch of said trouser portion to an inside thigh portion of the other leg of said trouser portion, said lower access means having excess fabric surrounding said crotch slit, said excess fabric contacting to cover said crotch slit until the patient is placed in an examination position.

13. A garment as claimed in claim 12, wherein, when said garment is laid flat, said excess fabric located at said inside thigh portion of one leg of said trouser portion at least partially overlaps said excess fabric located at said inside thigh portion of the other leg of said trouser portion.

* * * * *